US008302949B2

(12) United States Patent
Herpell et al.

(10) Patent No.: US 8,302,949 B2
(45) Date of Patent: Nov. 6, 2012

(54) APPARATUS AND METHOD FOR PRODUCING BOOK BLOCKS

(75) Inventors: Frank Herpell, Hamburg (DE); Thomas Hitscher, Hamburg (DE); Rainer Koetzer, Bargfeldt-Stegen (DE)

(73) Assignee: E.C.H. Will GmbH, Wedel (DE)

( * ) Notice: Subject to any disclaimer, the term of this patent is extended or adjusted under 35 U.S.C. 154(b) by 238 days.

(21) Appl. No.: 12/639,629

(22) Filed: Dec. 16, 2009

(65) Prior Publication Data

US 2010/0187745 A1 Jul. 29, 2010

(30) Foreign Application Priority Data

Dec. 17, 2008 (DE) ..... 10 2008 062 365

(51) Int. Cl.
*B41F 17/02* (2006.01)

(52) U.S. Cl. ..... 270/5.03; 270/5.02

(58) Field of Classification Search ..... 270/5.02, 270/5.03, 21.1

See application file for complete search history.

(56) References Cited

U.S. PATENT DOCUMENTS

| | | | | |
|---|---|---|---|---|
| 4,190,475 | A * | 2/1980 | Marschke | 156/157 |
| 5,107,656 | A * | 4/1992 | Katz et al. | 53/131.4 |
| 2007/0222805 | A1* | 9/2007 | Moscato et al. | 347/12 |
| 2008/0106022 | A1* | 5/2008 | Sussmeier et al. | 270/5.03 |
| 2010/0201056 | A1* | 8/2010 | Dawley | 270/21.1 |

FOREIGN PATENT DOCUMENTS

| | | |
|---|---|---|
| DE | 26 32 712 | 1/1978 |
| WO | 00/03876 | 1/2000 |

* cited by examiner

*Primary Examiner* — Patrick Mackey

(74) *Attorney, Agent, or Firm* — Greenblum & Bernstein, P.L.C.

(57) ABSTRACT

An apparatus for producing book blocks includes a station to dispense a sheet web that moves in longitudinal direction and can be imprinted. A printing station has two cylinders that rotate with a circumferential speed corresponding to the movement speed of the web and function to support in a contacting manner the web with their circumferential surfaces over a specified angle. Contactless printing heads are assigned to each cylinder, arranged at a distance to the circumferential surface of the associated cylinder, and positioned side by side and at least essentially transverse to the circumferential and rotational direction of the associated cylinder. The printing head faces are oriented substantially tangential to the associated cylinder and the center lines of the printing heads are oriented to project substantially radially to the circumferential surface of the associated cylinder. The web is guided so that when it rests on one cylinder, one side of the web is imprinted and when it rests on the other cylinder, the other side of the web is imprinted. A desired web tension is created in the printing station. A cutting station is arranged downstream of the printing station to cut the printed web in longitudinal and transverse directions to form sheets having a predetermined height and width. An overlapping station arranges the cut sheets into an overlapping formation. A station collects the sheets to produce stacks that form book blocks.

32 Claims, 9 Drawing Sheets

APPARATUS AND METHOD FOR PRODUCING BOOK BLOCKS

CROSS-REFERENCE TO RELATED APPLICATION

This application claims the priority of German Patent Application No. 10 2008 062 365.2-27, filed on Dec. 17, 2008, the subject matter of which is incorporated herein by reference in its entirety.

BACKGROUND OF THE INVENTION

The present invention relates to an apparatus and method for producing book blocks from a sheet web.

Book blocks and books are traditionally produced using several operational steps. With an apparatus operating with the cylinder printing method, the sheets are imprinted during a first step on the front and on the back according to a specific, predetermined diagram, which makes it possible to arrange successively following pages of the book block in the desired sequence by using suitable and in part very complicated folding operations. When using such a diagram, the page content is not printed in the sequence of the page numbers used for the book block, meaning directly following each other, either side by side or one behind the other, but is printed at different locations on the front and the back of a sheet, so that the pages will be in the corresponding sequence only at the conclusion of the aforementioned folding operations. The pages are initially still connected via the folds and need to be separated in a subsequent, special trimming step, among other things in a three-way trimming operation using a so-called three-way trimmer.

As a result of the holding capacity for different page contents, which is restricted to the printing cylinder circumference and width, a make ready of the printing cylinder is generally required several times for a book block having a higher number of different pages, wherein the cylinder is provided each time with the print image of a group containing the content of the still missing pages and the sheets must then be printed accordingly and folded once more in a subsequent folding operation. As an alternative, it is also possible to use several printing cylinders matched to the respective group. The groups formed in this way are initially stored in an intermediate storage area, which requires a corresponding amount of storage space. After all the groups have been printed, the pages of each group are folded according to the previously mentioned diagram, in most cases during several folding operations, and the individual groups are then gathered in the folded form into book blocks that are subsequently trimmed and bound. To be sure, the cylinder printing methods result in high-quality print, but they are relatively involved and require a complex storing logistic with corresponding storage capacity. Installations that use the cylinder printing method are furthermore restricted to a few formats which depend on the printing cylinder geometry. Frequently, a format change also requires a change in the printing cylinder geometry. Finally, empty pages are in part also required in dependence on the selected page number, which necessitate correspondingly empty surface sections on the printing cylinder, thereby reducing the effectiveness of the printing cylinder.

A method and an apparatus for the production of paper bundles is known from German patent document DE 26 32 712 A1, for which an endless paper web of a multiple bundle width is imprinted on both sides with repeating rows of different types of printing images with the aid of printing cylinders, is then separated by cutting it in a longitudinal direction into several partial webs. The partial webs are then cut in a transverse direction into individual sheets and the sheets from two adjacent partial webs are then collected by placing them one above the other in a transfer device. This known apparatus also operates with the rather inflexible use of printing cylinders, as well as with the rather time-intensive collecting operation.

SUMMARY OF THE INVENTION

It is therefore an object of the present invention to provide an apparatus which makes possible a simple and easy production of book blocks.

The above and other objects of the invention are accomplished whereby, according to one embodiment, there is provided an apparatus for producing a book block, comprising:

a sheet web dispensing station to dispense at least one sheet web that moves in a longitudinal direction and can be imprinted;

a printing station, including: two cylinders which rotate with a circumferential speed that corresponds to a movement speed of the sheet web and which function to support in a contacting manner the sheet web with their circumferential surfaces over a specified angle region; contactless operating printing heads assigned, respectively, to each cylinder, arranged side by side at a distance to the circumferential surface of the associated cylinder and positioned at least essentially transverse to the circumferential and rotational direction of the associated cylinder, wherein the printing heads have faces oriented substantially tangential to the associated cylinder and wherein the center lines through the printing heads are oriented to project substantially radial to the circumferential surface of the associated cylinder; a guiding device to guide the sheet web so that when the web rests on one cylinder, one side of the sheet web may be imprinted and when the web rests on the other cylinder, the other side of the sheet web may be imprinted; and a web tension device to generate a desired web tension in the sheet web;

a cutting station arranged downstream of the printing station and including:

- a longitudinal cutter operative to cut the printed sheet web in a longitudinal direction; and
- a cross-cutter arranged downstream or upstream of the longitudinal cutter to cut the printed sheet web in a transverse direction,
- wherein the cutting station produces sheets that have a width and length that correspond to a predetermined height and width of pages of the book block to be produced;

an overlapping station arranged downstream of the cutting station to arrange the sheets in an overlapping formation; and a collecting station to collect the sheets of each partial web into stacks that form the book blocks.

As opposed to the traditional printing methods, the invention now makes it possible to produce book blocks in a continuous and so-to-speak uninterrupted operation, in a simple and format-flexible manner. Combining the contactless printing operation with the use of longitudinal and cross-cutting stations for producing individual sheets, arranged successively in the movement direction from the side by side formed partial webs and subsequently collecting these sheets in the collecting station to form book blocks, results in high format flexibility along with a simultaneously high production speed. Forming several side by side arranged partial webs leads to a multi-track arrangement, which permits the simultaneous production of several book blocks and correspondingly increases the output and capacity of the apparatus multiple times. The multi-track arrangement furthermore has the advantage that it optionally allows not only to produce book blocks with identically printed sheets or pages, but also permits the simultaneous production of book blocks with differently printed sheets or pages. The use of contactless operating printing heads, which are generally controlled by a print-image processing system, in this connection allows a completely free and optional design of the print, which can also differ for each partial web, if necessary, as previously mentioned.

By using the cylinders to support in a contacting manner the sheet web during the printing operation with the contactless printing heads and by generating a tension in the sheet web, a fluttering or swimming of the sheet web is furthermore avoided during the printing operation, thus making it possible to achieve excellent printing quality and avoid poor and fuzzy print images.

The invention permits the production of a plurality of book block formats having different dimensions for the book block pages, wherein at most short makeready times are required. The stations for folding, creasing or collecting printed sheets, which are otherwise required for the traditional book block production, are no longer needed, meaning the configuration of the apparatus as well as its operation are simplified. If the sheets of the partial webs in particular are gathered inside the collecting station until the specified total number is reached, then a complete book block can be formed simply with the sheets obtained from a single partial web.

Accordingly, a conveying path, without folding and gathering stations, for conveying the sheets to the collecting region can thus be embodied between the arrangement consisting of the longitudinal cutting station and the cross-cutting station on one side and the collecting station on the other side, thereby making it possible to produce complete book blocks solely by using sheets from a single partial web. Required for this is only an overlapping station for initially arranging the sheets of each partial web in an overlapping formation, which is a precondition for stacking the sheets one above the other.

The sequence in which the longitudinal cutting station and the cross-cutting station are arranged is basically not important. According to one embodiment, the cross-cutting station is arranged downstream of the longitudinal cutting station and, as seen in the movement direction of the sheet web, follows the longitudinal cutting station. According to another embodiment, the sequential arrangement of the cross-cutting station and the longitudinal cutting station is reversed.

According to another aspect of the invention, there is provided a method for producing book blocks, which in one embodiment comprises the following steps:

providing at least one sheet web that moves in a longitudinal direction and that can be imprinted;

pulling the sheet web through a printing station successively across two cylinders to form a wrap-around angle about each cylinder and imprinting the web with the aid of contactless operating printing heads that are assigned to each cylinder and are arranged side by side at a distance to the circumferential surface of the associated cylinder, and at least essentially transverse to the circumferential and rotational direction of the associated cylinder, wherein the faces of the printing heads are oriented substantially tangential to the associated cylinder and center lines of the printing heads are oriented to project substantially radial to the circumferential surface of the associated cylinder;

guiding the sheet web with a specified web tension through the printing station so that when the web rests on the one cylinder, one side of the sheet web is imprinted and when the web comes to rest on the other cylinder, the other side of the sheet web is imprinted;

longitudinally cutting the imprinted sheet web in a longitudinal direction;

transversely cutting the imprinted sheet web transverse to the conveying direction, wherein the longitudinal and transverse cutting steps produce sheets that have a length and width that correspond to a predetermined height and width of pages of the book block to be produced;

arranging the sheets in an overlapping formation; and collecting the overlapped sheets from inside a collecting station to produce stacks that form book blocks.

The term "sheet web" is understood to refer to a quasi endless web of flat material, which may be supplied while wound onto a roll and is pulled from this roll for the processing in the herein-mentioned apparatus, wherein the sheet web preferably is a paper web. However, a film web or a textile web to be imprinted using the method and the apparatus according to the invention can conceivably also be used.

The web dispensing station, also referred to as unrolling station, may comprise a holding device for accommodating at least two rolls, wherein only one sheet web is respectively pulled off one of the two rolls. The station may furthermore contain a joining device for joining the end of a completely unwound sheet web to the beginning of a sheet web that is still rolled up completely on a different roll, thus making it possible to realize a fast changeover between the rolls.

To support the conveying of the sheet web, a forward pulling device may be arranged downstream of the printing station.

According to another embodiment there may be provided a device to remove any waviness, curvature and/or twisting that may exist in the sheet web and which is generally caused by the unrolling and/or the printing operation. This device may be arranged downstream of the printing station and may adjust the sheet web on both sides. According to one modification of this embodiment, this adjustment device may be arranged downstream of the aforementioned forward pulling device, such that it may also remove any waviness that may have been generated as a result of the mechanical pulling force of this device.

In another embodiment, a wetting or moistening device may apply liquid to the sheet web, wherein the liquid may be provided for discharging a possibly existing electrostatic load against mass or ground and/or for refining the surface of a sheet web. According to one modification, the wetting device may comprise an antistatic device. In addition, the wetting device of the apparatus may be installed downstream of the device for adjusting the sheet web, for example, on both sides.

For a flexible format adaptation, the longitudinal cutting station may include a plurality of knives, for which the spacing in the transverse direction may be adjusted. The spacing between adjacent longitudinal cutting knives determines the width of the partial web section to be cut and thus also the width of the sheets produced from the partial web section.

The longitudinal cutting station may also be provided with a device for vacuuming the edge strip.

A diverter for separating out poor quality sheets may be arranged downstream of the arrangement consisting of the longitudinal cutting station and the cross-cutting station. A conveyor belt, for example, a conveyor belt for removing waste material at an angle and such as at approximately a right angle to the sheet web movement direction, may follow the diverter for separating out poor-quality sheets. The diverter for separating out poor quality sheets may be followed by an overlapping station arranged in which the sheets are arranged in an overlapping or scaled formation.

The collection station follows the overlapping station and may comprise compartments that correspond to the number of partial webs and are used for collecting the sheets from each partial web into book blocks, thus supporting the production of a complete book block that is composed solely of the sheets from a single partial web. Each compartment may be assigned a conveyor gripper for conveying away the book block gathered therein.

An intermediate storage unit for the intermediate storage of book blocks may be connected to the collecting station.

A conveying device for conveying the book blocks to a binding station may branch off at an angle from the collecting station, for example, at approximately at a right angle to the movement direction of the sheet web. If applicable, this conveying device can extend to the previously mentioned intermediate storage unit and may simultaneously also be used for operating this storage unit. The conveying device may be provided with at least one conveying belt.

A feeding device may also be provided, which extends to the conveying device as well as to the intermediate storage unit.

A drying unit for drying the imprinted sections of the sheet web may also be provided.

At least one control unit for controlling the web edges may be used. This unit for controlling the web edges may be a part of the printing station and may be arranged upstream of at least one of the two cylinders.

At least one quality-measuring device may also be provided. When using such a quality-measuring device, the diverter for separating out poor-quality sheets may be activated for separating out the sheets which have been determined to be of poor quality by the quality-measuring device. At least one such quality-measuring device may be provided in the printing station, wherein a quality-measuring device is assigned to a cylinder and determines the quality of the sheet web once it leaves the cylinder.

BRIEF DESCRIPTION OF THE DRAWINGS

These and other features and advantages of the invention will be further understood from the following detailed description of embodiments with reference to the accompanying drawings, in which.

DETAILED DESCRIPTION

Figure 1:
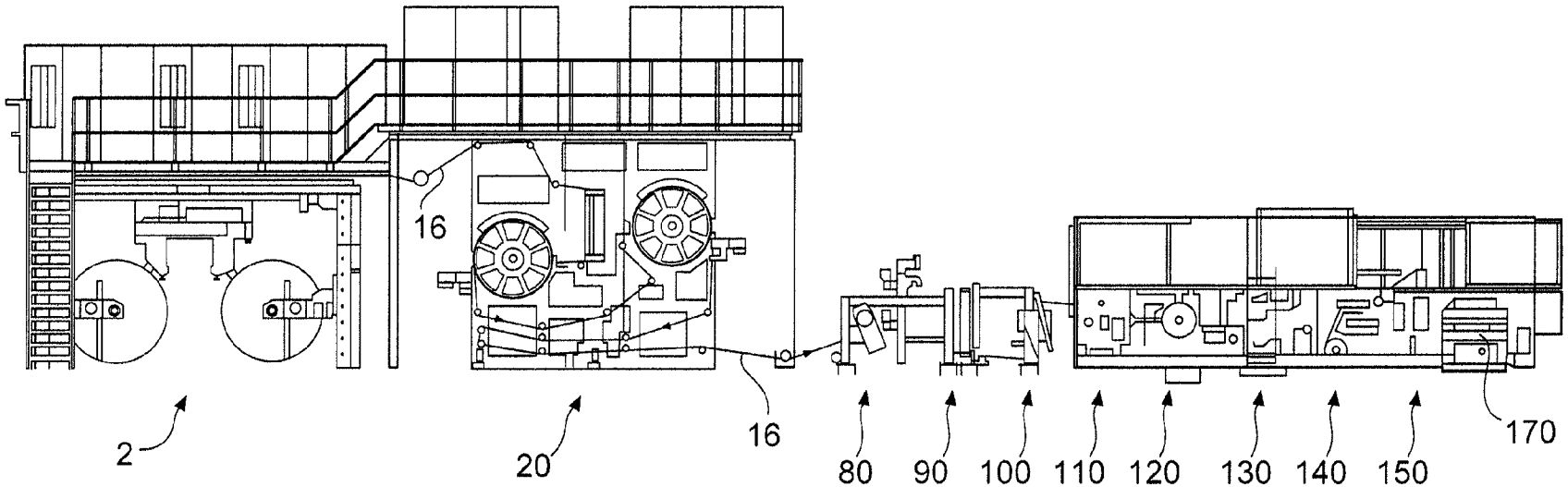
FIG. 1 is a schematic view from the side of an apparatus for producing book blocks, showing an embodiment of the invention.
Figure 2:
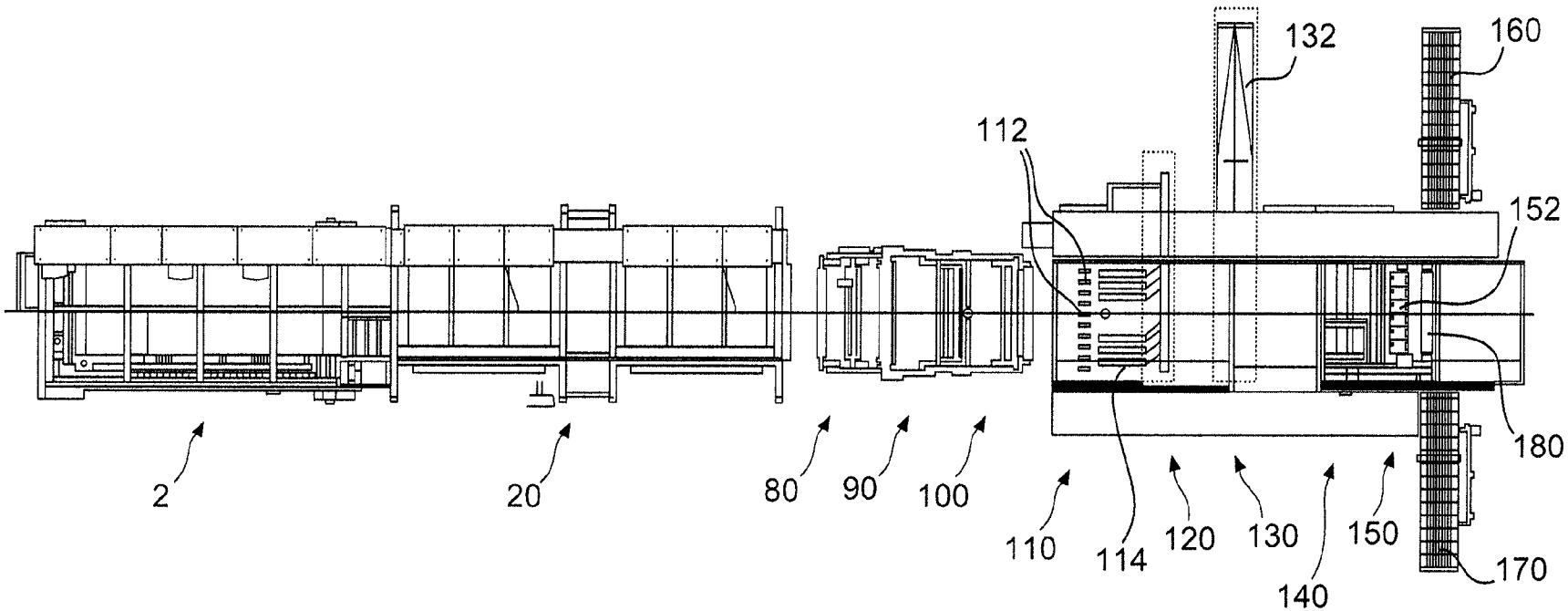
FIG. 2 is a schematic view from the top of the apparatus shown in FIG. 1.
Figure 3:
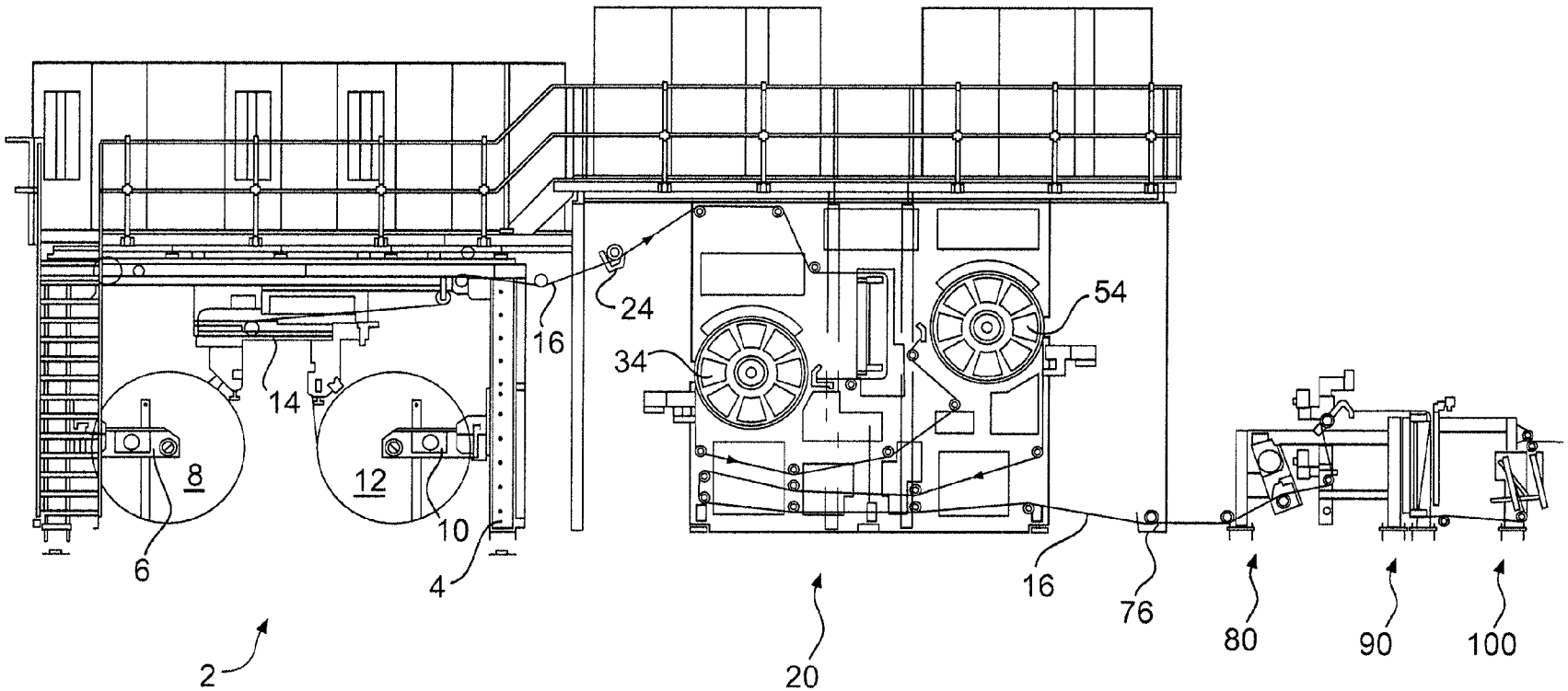
FIG. 3 is an enlarged schematic view from the side of the apparatus according to FIG. 1, showing the section from a web unrolling station to a wetting station for the sheet web.

An embodiment, essentially shown completely in FIGS. 1 and 2 and in some detail in FIG. 3, is provided at a starting end with a sheet web dispensing station 2 including a frame 4 as seen in FIG. 3. For the embodiment shown herein, a first support arm 6 is arranged on frame 4 for accommodating a first roll 8, along with a second support arm 10 for accommodating a second roll 12. The rolls 8, 12 are positioned on the support arms 6, to rotate on pivots, so-called mandrels, which are not shown in further detail herein, and can also be removed from the support arms. The support arms 6, 10 are positioned on the frame 4, to be displaceable in a vertical direction between an upper operating position and a lower resting position, wherein the rolls can be exchanged when in the lower resting position.

Each roll 8, 12 consists of a wound up endless sheet web, for example made of paper, which is subsequently unwound from the respective roll for the processing operation described in further detail in the following. For this embodiment, only one roll is respectively used during the operation while the other roll can be replaced in the meantime. Once the sheet web is completely pulled from the one roll, the operation shifts to pulling the sheet web from the other roll while the empty roll is replaced with a new and full roll. To avoid any interruption in the running operation of the apparatus, the end of the sheet web from the one roll may be joined to the start of the sheet web from the other roll. For this, the sheet web dispensing station 2 may be provided with a splicing device 14, arranged for this embodiment on the frame 4 above the support arms 6, 10 and thus above the rolls 8, 12. The splicing together normally occurs during a stop in the operation, but can also be realized during the running operation.

To compensate for a possible shortfall in the sheet web material, for example during the previously mentioned splicing operation during the standstill, a sheet web storage unit is provided in the sheet web dispensing station 2.

Upon leaving the dispensing station 2, the sheet web that is given the reference number 16 in the Figures reaches a printing station 20 in which the desired print images are printed onto the sheet web 16. The sheet web movement direction in the Figures is from the left to the right.

Figure 4:
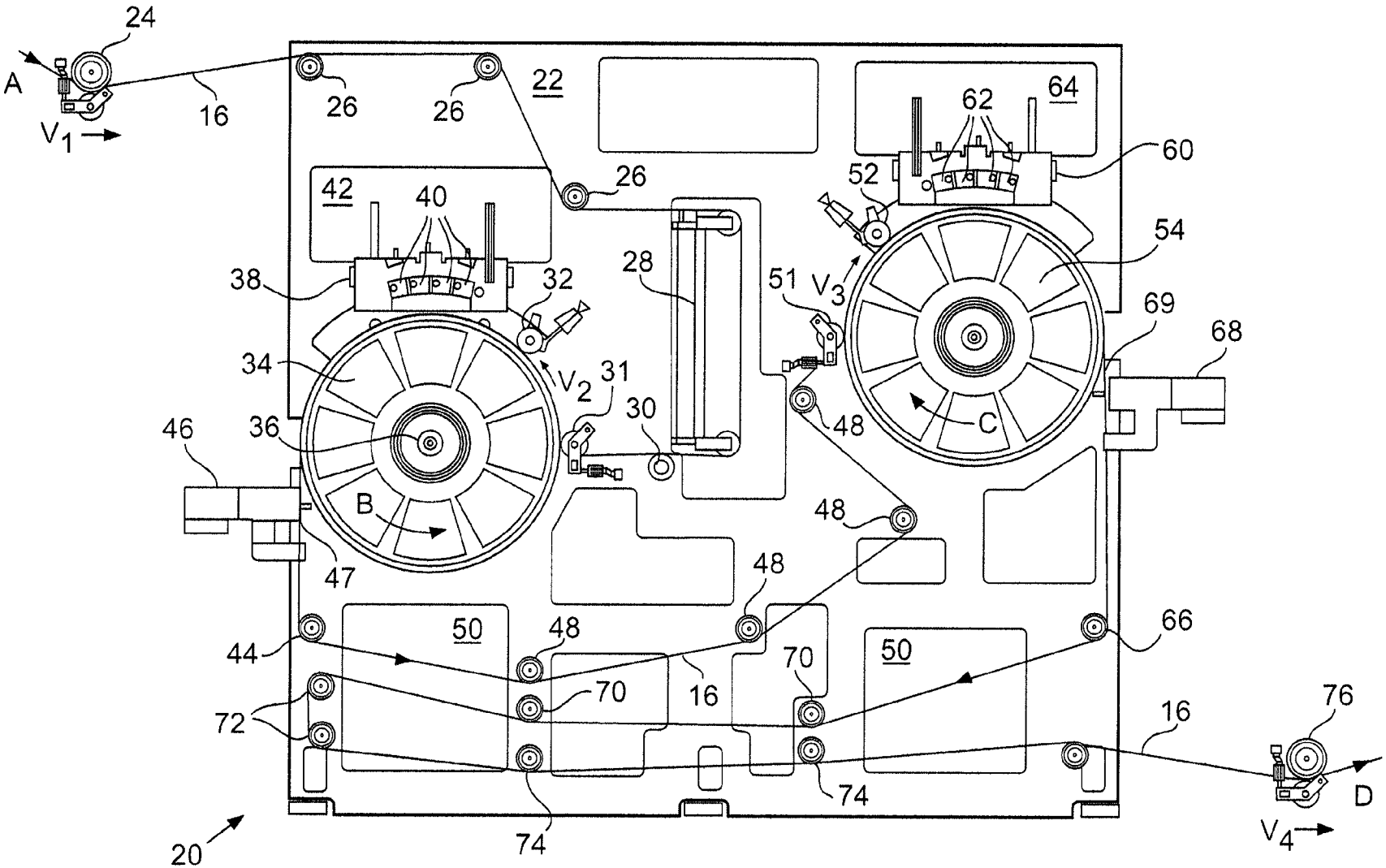
FIG. 4 is a further enlarged view from the side of a printing station for the apparatus shown in FIG. 1.
Figure 5:
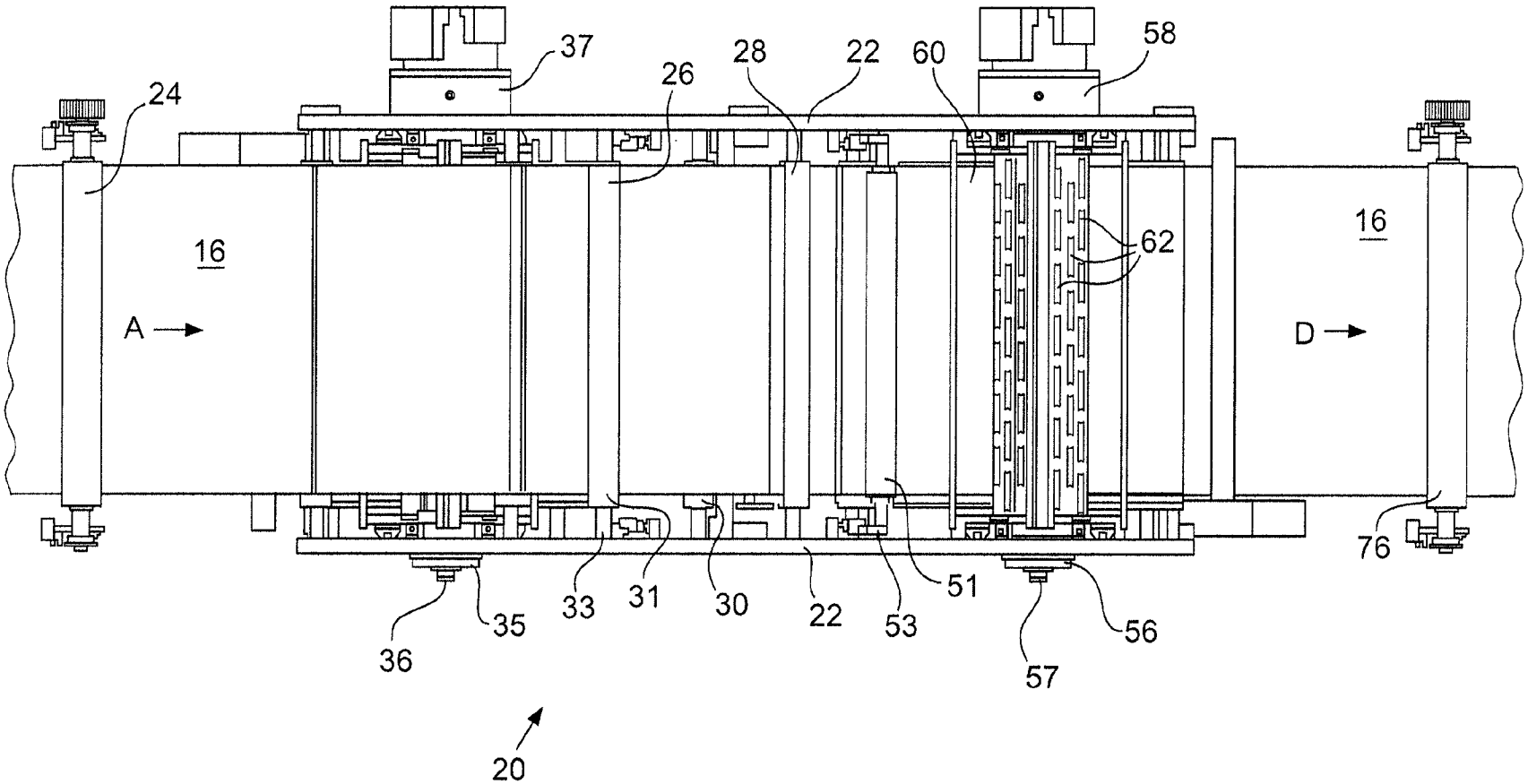
FIG. 5 is a view from above of the printing station, rotated by 90° as compared to FIG. 4.

The printing station 20 is illustrated in further detail in FIGS. 4 and 5. FIG. 5 shows that the printing station 20 has a frame 22 with thereon arranged different units that are described in further detail in the following. For a better representation of these units, the side of the frame 22 that is facing the viewer is omitted in FIG. 4 to provide a clearer view.

Prior to entering the printing station 20 in the direction of arrow A, the sheet web 16 passes through a first draw roller arrangement 24 in the intake region of the printing station 20. This draw roller arrangement 24 is driven by a drive, not shown in further detail herein, and imposes a first conveying speed $v_1$ on the sheet web 16. Once the sheet web 16 enters the printing station 20, it is guided over several guide rollers 26 to a web edge alignment device 28. Along this section of the conveying path, a wetting device can optionally also be provided upstream of the web edge alignment device 28, wherein this wetting device is not shown in the Figures. The web edge alignment device 28 is used for orienting the sheet web 16 transverse to the web-movement direction, relative to the printing devices that are described in the following, so that the printing images are positioned precisely in the desired position as seen in the transverse direction of the web-movement direction.

Once the sheet web 16 leaves the web-edge alignment device 28, the sheet web 16 is guided over a guide roller 30 to a first deflection roller 31, which fits against the circumference of a first cylinder 34 and is provided with a shaft encoder 33. The shaft encoder preferably comprises a high-resolution angle-measuring system (>3600 l/U; preferably 9000 l/U). The first cylinder 34 is positioned rotating on a bearing 35 which is attached to the frame 22 for the printing station 20 and is provided with a shaft encoder 36 for determining the momentary rotational position of the first cylinder 34 as well as its rotational speed. The shaft encoder 36 preferably has a high-resolution angle measuring system (>3600 l/U; preferably 36000 l/U). The first cylinder 34 is driven in the direction of arrow B with a circumferential speed $v_2$ with the aid of a direct drive that is provided with a servomotor, not shown further herein, and is mounted on the frame 22. FIG. 4 shows that the sheet web 16 for this embodiment moves approximately radial with respect to the first cylinder 34 and is deflected by deflection roller 31 in a direction of the circumferential surface of the first cylinder 34.

Downstream of the first deflection roller 31 and thus at a specific angular distance thereto, a first press-on roller 32 may be provided, which also fits against the circumference of the first cylinder 34. This first press-on roller 32 pushes the sheet web 16 against the circumferential surface of the first cylinder 34, so that sheet web 16 makes contact with the circumferential surface of the first cylinder 34. The first press-on roller 32 is pushed with a pressure-admitting device, not shown in further detail herein, against the circumferential surface of the first cylinder 34, wherein the pressure-admitting device may have an energy store such as a spring or may have an active drive. The sheet web 16 may be pushed against the first cylinder 34 in the radial direction of the circumferential surface or at a different angle of inclination.

The first press-on roller 32 and the first cylinder 34 together form a type of draw roller arrangement for driving the sheet web 16, positioned on the circumferential surface of the first cylinder 34, with the conveying speed $v_2$, wherein this speed is slightly higher than the conveying speed $v_1$. Thus, while the first press-on roller 32 presses the sheet web 16 with a force against the first cylinder 34, thereby preventing any slip between the sheet web 16 and the circumferential surface of the first cylinder 34, the first deflection roller 31 guarantees the desired wrap-around angle.

The sheet web 16 is pulled by the draw roller arrangement of the first cylinder 34 and press-on roller 32 across approximately half the circumference of the first cylinder 34 before the web leaves the first cylinder 34 again in the tangential direction, so that the wrap-around angle of the sheet web 16 around the first cylinder 34 is approximately 180° in this embodiment. In principle, it is also conceivable to select a different wrap-around angle which is at least somewhat smaller or larger than the 180° angle. The rotational speed of the first cylinder 34 in this case is selected such that its circumferential speed is equal to the speed of the sheet web 16.

Once it has traveled about half the distance over the wrap around angle of the first cylinder 34, the sheet web 16 in the embodiment shown in FIG. 4 is guided past a printing unit 38 where the printing operation takes place. That is, the side of sheet web 16 pointing toward the outside is imprinted with desired print images. The first press-on roller 32 is arranged adjacent to the printing unit 38. For the embodiment shown herein, the first press-on roller 32 is therefore located between the deflection roller 31 and the printing unit 38, wherein it is also conceivable to position the first press-on roller 32 directly on the printing unit 38. To realize the printing operation, the printing unit 38 may include a plurality of contactless operating printing heads 40, arranged at a distance to the circumferential surface of the first cylinder 34 and thus to the sheet web 16. The faces of the printing heads 40 are furthermore oriented essentially tangential to the circumferential surface of the first cylinder 34 and the center lines of the printing heads are oriented to project essentially radial to the first cylinder 34. FIG. 4 furthermore shows that a plurality of printing heads 40 are arranged in the rotational direction of the first cylinder 34, as shown with arrow B, meaning they are arranged successively in the circumferential direction of the roller and in the movement direction for the sheet web 16.

Figure 6:
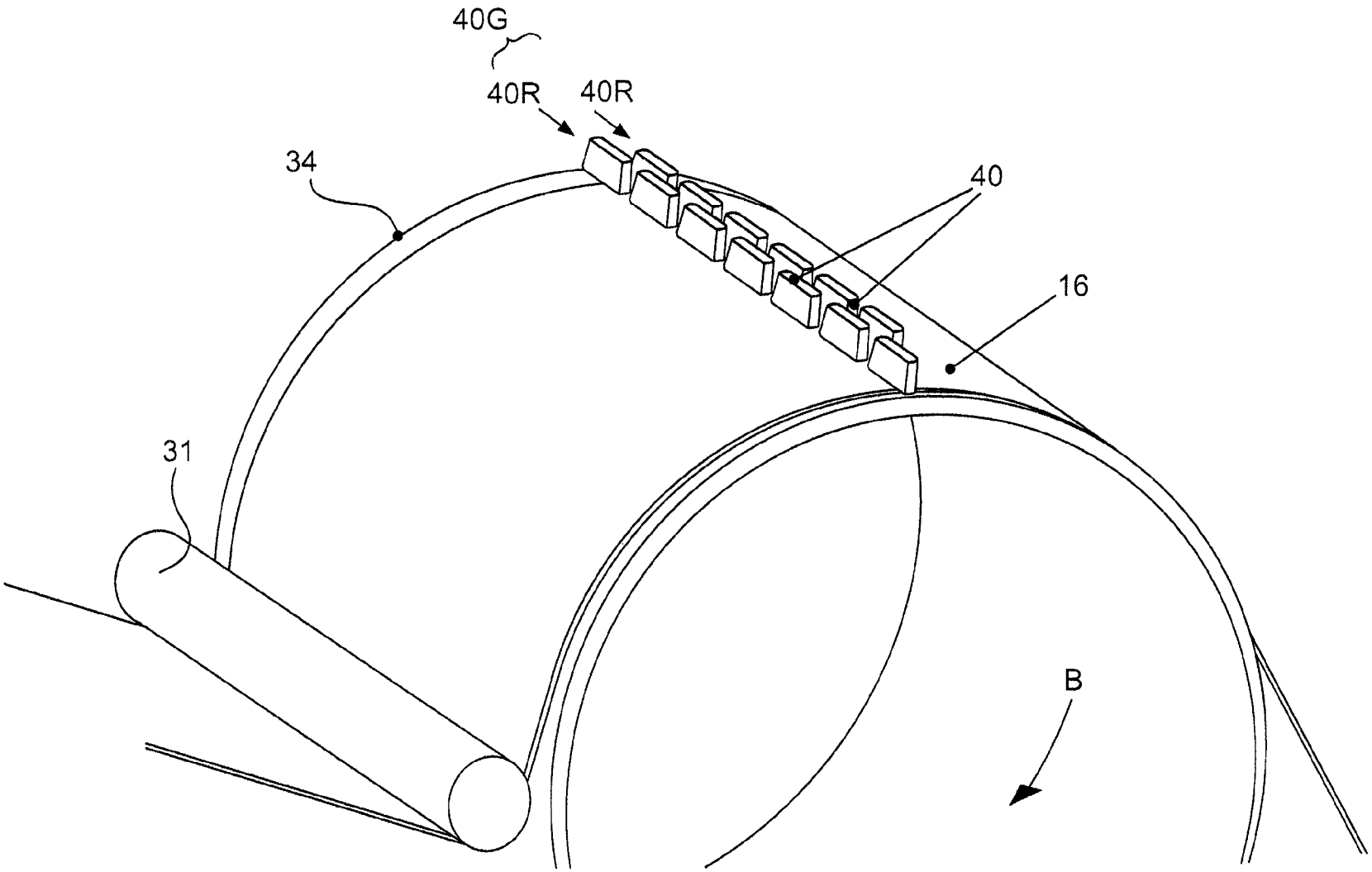
FIG. 6 shows details of a perspective representation of an arrangement comprising a press-on roller, a cylinder and a group of printing heads consisting of two successively arranged rows of printing heads.

FIG. 6 shows an arrangement consisting of the first deflection roller 31, the first cylinder 34, and the printing heads 40, but does not show the first press-on roller 32. FIG. 6 shows a different perspective than the one shown in FIG. 4, wherein each printing head 40 that is arranged transverse to the web-movement direction occupies only a fraction of the width of the sheet web 16. The printing heads 40 are combined into two rows 40R, positioned one behind the other in the web-movement direction, which jointly form a group 40G. Each row in this case consists of a specific number of printing heads 40, positioned side by side and transverse to the web-movement direction, wherein this row extends over the complete width of the sheet web 16. The printing heads 40 of the two adjacent rows 40R in the Group 40G are furthermore positioned offset to each other. For the embodiment shown herein, this offset arrangement of the printing heads 40 respectively results in one printing head 40 of the one row 40R overlapping with its ends on the side with the ends of the printing heads 40 of the other row 40R. FIG. 6 furthermore illustrates that the printing heads 40 of each row 40R are arranged with the same division, meaning each row 40R of printing heads 40 has the same division. The offset arrangement of the printing heads 40 relative to each other takes into account the fact that with each printing head 40, its casing transverse to the web-movement direction is wider than the effective printing region. On the one hand, it is thus possible to print a continuous line extending over the total width of the sheet web 16 if necessary, while on the other hand more complicated print images that extend into the edge region of the sheet web 16 can also be realized.

Figure 7:
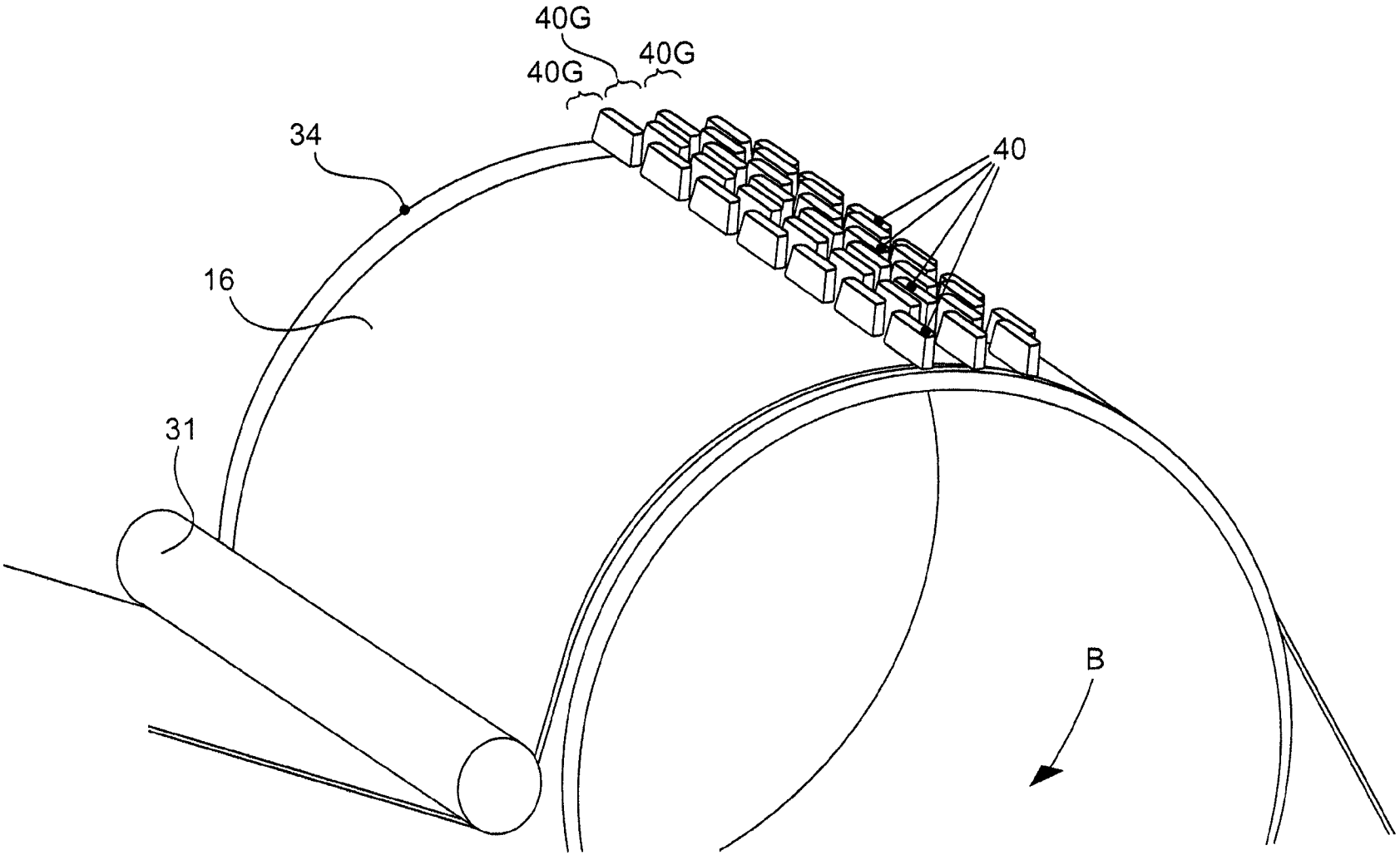
FIG. 7 is a schematic, perspective representation of an arrangement with a press-on roller, a cylinder and two groups with respectively two rows of printing heads.

However, since each printing head 40 can only operate up to a maximum frequency, the web-movement speed which corresponds to the circumferential speed in the direction of arrow B would be restricted to a maximum value. For that reason, several groups 40G of printing heads 40 are arranged successively in web-movement direction, as shown in FIG. 6, to make possible a printing at a higher web speed. FIG. 7 shows a view of an arrangement from the same perspective as shown in FIG. 6, which includes the first deflection roller 31, the first cylinder 34 and the printing heads 40, while omitting the press-on roller 32. In addition, FIG. 7 shows six rows of printing heads 40 arranged in three successive groups 40G. This makes it possible to realize three-times the speed as compared to using a single group 40G as disclosed in FIG. 6 with only two successively arranged rows. In the arrangement of FIG. 7, each printing head 40 only needs to print every third dot to obtain a continuous line in the web-movement direction.

Figure 8:
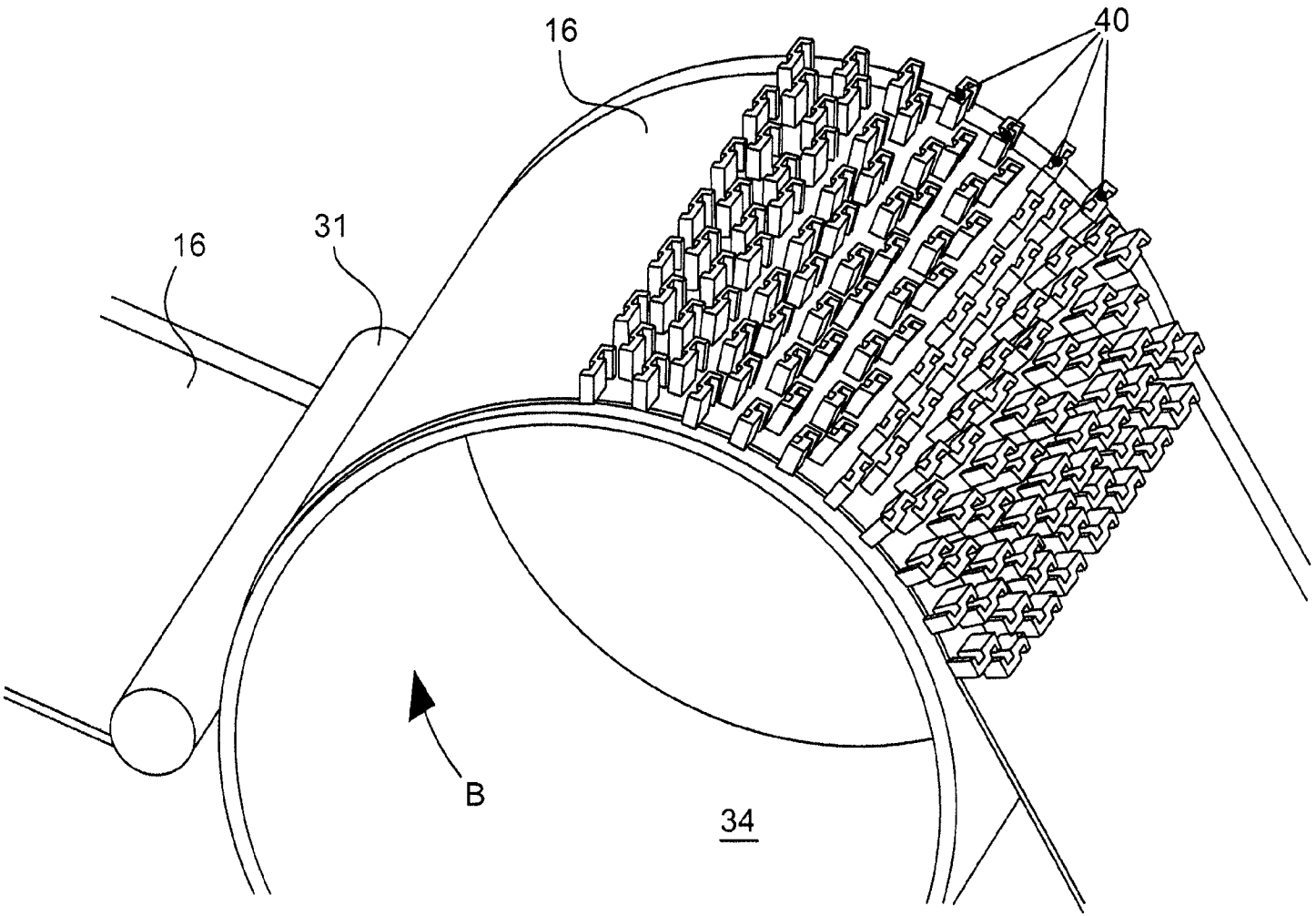
FIG. 8 is a schematic, perspective representation of an arrangement with a press-on roller, a cylinder and ten groups comprising respectively two rows of printing heads.

For a full-color printing, a single color is printed per group (comprising two rows 40R of printing heads 40, arranged one behind the other). Multiplied with the number of groups for the correspondingly required speed, we then obtain the required number of groups. FIG. 8 illustrates an embodiment for a full-color printing with ten groups. As in FIGS. 6 and 7, FIG. 8 shows a perspective view which includes the first deflection roller 31, the first cylinder 34 and the printing heads 40, while omitting the press-on roller 32.

FIG. 8 also shows that the printing unit 38 (FIG. 4) does not necessarily have to be positioned approximately in the center between the first deflection roller 31 and the location where the sheet web 16 leaves the first cylinder 34 again, but can also be located at a different location along the path traveled by the sheet web 16 over the circumference of the first cylinder 34. It must be noted in this connection that for achieving a high printing quality, it is advantageous if the first press-on roller 32 is essentially arranged directly adjacent to the printing unit 38, as shown with FIG. 4.

The printing heads 40 used in the above embodiments may be jet-printing heads, such as inkjet-printing heads.

The printing unit 38 is positioned on a holder 42, attached to the frame 22, such that the printing unit can move in radial direction relative to the first cylinder 34. In this way, the printing unit 38 can be moved from an operating position, in which the printing heads 40 are located at a comparatively short distance to the circumferential surface of the first cylinder 34 and thus also from the sheet web 16, to a rest position in which the printing unit 38 and thus the printing heads 40 are located at a considerably longer distance to the first cylinder 34, thereby providing sufficient clearance space for repair, maintenance and/or adjustment operations. The printing unit 38 is primarily moved to the rest position for cleaning, repair, maintenance and/or adjustment operations that must be carried out. In FIG. 4, the printing unit 38 is in the raised rest position.

As previously mentioned, the sheet web 16 is pulled tangentially off the circumferential surface of the first cylinder 34. A guide roller 44 is arranged relative to the first cylinder 34 so that the section of the sheet web 16 that leads from the first cylinder 34 to this guide roller moves in a tangential direction, relative to the circumferential surface of the first cylinder 34, as shown in FIG. 4. Arranged along this tangential path section, at a location adjacent to the first cylinder 34, is an arrangement consisting of a first quality measuring device 46, for example comprising a non-depicted stroboscopic high-speed camera, and a so-called first table sheet 47. As can be seen in FIG. 4, the sheet web 16 moves between a front for the first quality-measuring device 46 and the first table sheet 47 that extends approximately in the plane for the sheet web 16, wherein the sheet web 16 is located at a minimum distance to the first table sheet 47. A thin cushion of air is thus generated between the first table sheet 47 and the sheet web 16, on which the sheet web 16 glides over the first table sheet 47. The first quality-measuring device 46 functions to check the quality of the print image that is freshly applied to one side of the sheet web 16, wherein the tangential path section after leaving the first cylinder 34 is particularly suitable for this because the sheet web 16 follows an especially straight course after being pulled from the first cylinder 34.

In the illustrated embodiment, the tangential path section from the first cylinder 34 to the guide roller 44 extends downward in an approximately vertical direction. The sheet web 16 experiences a deflection at the guide roller 44 to an approximately horizontal direction and, in the process, is guided through a drying unit 50 in which the sheet web 16 is dried, thereby preventing a smudging of the previously applied print images. By way of additional guide rollers 48, the sheet web 16 arrives at a second deflection roller 51 and a second press-on roller 52, which both make contact with a second cylinder 54. The second deflection roller 51 is also provided with a shaft encoder 53. An additional web-edge control device, similar to the web-edge control device 28, may be provided upstream of the second deflection roller 51 to ensure a highly precise web movement with respect to the printing heads 62 of the second printing unit.

The second cylinder 54, which is positioned via a bearing 56 that is also provided with a shaft encoder 57 for detecting the rotational position and the rotational speed of the second cylinder 54, is also arranged on the frame 22 and is driven by a direct drive 58 that is arranged on the frame 22. The second cylinder 54 in this case rotates with a rotational speed $v_3$ in the direction of arrow C. A second printing unit 60 is assigned to the second cylinder 54 and is displaceable between an operating position and a rest position. The printing unit 60 is provided with printing heads 62 and a holder 64 that is attached to the frame 22. FIG. 4 furthermore shows the second printing unit 60 in the lifted up rest position. With respect to design and function of the second deflection roller 51 and its shaft encoder 53, the second press-on roller 52, the second cylinder 54 with its bearing 56, the shaft encoder 57, the direct drive 58, the printing heads 62 and the holder 64, reference is made to the previously provided extensive description of the first deflection roller 31 and its shaft encoder 33, the first press-on roller 32 of the first cylinder 34 and its bearing 35, the shaft encoder 36, the direct drive 37, the printing heads 40 and the holder 42. It must furthermore be mentioned here that instruments for measuring the pressing force of the first and the second press-on rollers 32, 52 may also be provided.

The sheet web 16 is thus also imprinted with the aid of the printing heads 62 while located on the second cylinder 54. In contrast to the printing on the first cylinder 34, however, the still blank side of the sheet web 16 is imprinted when the web is located on the second cylinder 54 on which the sheet web 16 is positioned with the previously imprinted side facing the second cylinder 54, such that the blank side is exposed for the printing operation. This is achieved according to the illustrated embodiment by positioning both cylinders 34, 54 spatially one behind the other in the web-movement direction, by rotating the second cylinder 54 in the direction of arrow C and counter to the rotational direction of the first cylinder 34, and by guiding the sheet web 16, once it leaves the first cylinder 34, via the guide rollers 44 and 48 along a curved path to the second cylinder 54 to be fitted against the circumferential surface of the second cylinder 54 on the opposite side of cylinder 54 that faces the first cylinder 34. The second press-on roller 52 together with the second cylinder 54 therefore forms a type of third draw roller arrangement, which drives the sheet web 16 with the speed $v_3$ in web movement direction. To achieve a defined tensile stress and thus a stretching of the sheet web 16, the speed $v_3$ is slightly higher than the speed $v_2$, wherein it is also conceivable that both cylinders 34, 54 rotate with precisely the same circumferential speed.

Similarly to the guide roller 44, the guide roller 66 also serves to pull the sheet web 16 tangentially from the second cylinder 54. Shortly after leaving the second cylinder 54, the sheet web 16 passes between a second quality measuring device 68 and an opposite-arranged second table sheet 69. In the same way as the first quality measuring device 46, the second quality measuring device 68 also functions to measure the quality of the print. In contrast to the first quality measuring device 46, however, the second quality measuring device 68 functions to check the quality of the print image now applied by the printing heads 62 to the second side of the sheet web 16.

Following the deflection at the guide roller 66, the sheet web 16 is moved through an additional drying unit 50, over additional guide rollers 70 and back to the previously mentioned drying unit 50, so as to dry the second side of the sheet web 16, imprinted while on the second cylinder 54, and to prevent a smudging of the print images applied to the second side by the printing heads 62. The need for drying units 50 and their mode of operation depend to a high degree on the print medium dispensed by the printing heads 40, 62 and the movement speed of the sheet web 16.

Once the sheet web 16 has again passed through the drying unit 50, it is deflected by guide rollers 72 and is moved past additional guide rollers 74 to a second dual-cylinder arrangement 76 which is positioned in the discharge region for the printing station. The sheet web 16 passes between these cylinders before the sheet web 16 leaves the printing station 20 in the direction of arrow D. The two cylinders of this dual-cylinder arrangement 76 are driven by a drive that is not shown herein. The pulling force and/or the advancing force generated by the second dual-cylinder arrangement 76 and applied to the sheet web 16 is slightly higher than the pulling force and/or the advancing force generated by the first dual-cylinder arrangement 24 in the intake region of the printing station 20. As a result of this difference, a pulling and/or web tension is generated in the sheet web 16 when it passes through the printing station 20. The first dual-cylinder arrangement 24 acts as a type of deceleration drive, relative to the downstream-arranged, driven dual-cylinder arrangements formed by the first cylinder 34/first press-on roller 32, the second cylinder 54/second press-on roller 52 and the second dual-cylinder arrangement 76. The following inequality expresses the ratio of the speeds, relative to each other:

$$v_1<v_2<v_3<v_4.$$

A defined tensile stress and thus a defined stretching and/or web expansion as well as slip freedom can be achieved in this way between the sheet web 16 and the cylinders 34, 54, wherein the deviations between the individual speeds are at most in the percentage range of a thousandth and the speed increase in particular amounts to approximately one thousandth in each case.

By guiding the sheet web 16 over the cylinders 34 and 54 and thus over a semi-circular, curved path with a predetermined web tension past the printing heads 40 and 62, an especially precise positioning of the sheet web 16, relative to the printing heads 40 and 62, can be obtained and a fluttering or swimming of the sheet web 16 avoided, thus making it possible to produce print images of especially high quality at a high production speed. The web tension in the sheet web 16 along the circumference of the cylinders 34 and 54 with formed-in curvature is primarily maintained by the press-on rollers 32 and 52 by means of which the sheet web 16 is respectively fed on the intake side against the circumferential surface of the cylinders 34, 54, whereas the sheet web is pulled on the output side tangentially from the circumference of the cylinders 34, 54. The first and second dual-cylinder arrangements 24 and 76 help generate the tension in the sheet web 16 and ensure that the sheet web 16 remains under a predetermined tension essentially over the complete distance traveled through the printing station 20.

A superimposed control unit that is not shown in the Figures is used to evaluate the measuring signals transmitted by the measuring systems in view of a slippage of the sheet web 16, relative to the cylinders 34 and 54. If a slippage of the web is detected, the option exists in particular to reduce the slippage by changing the press-on force of the rolls 32 and 52, to compensate for the slippage by transmitting signals to a printing head control, also not shown herein, for example by using the control to gate in corresponding dead times into the operating frequency for the printing heads 40, 62, by reducing the speed of the sheet web 16, or simply by issuing a corresponding warning.

After leaving the printing station 20, the imprinted sheet web 16 for the illustrated embodiment passes through a forward-feed station 80, which supports the transport of the sheet web 16 in the web movement direction.

The forward-feed station 80 of the embodiment shown herein is followed downstream by an adjustment station 90 in which the sheet web 16 is adjusted, preferably on both sides and thus in both directions, so as to remove a possible waviness caused by the printing operation.

The sheet web 16 then moves through a wetting station 100, which is embodied for spraying the sheet web 16 with water vapor or a liquid vapor to discharge a possibly existing electrostatic charge in the sheet web 16 against mass and/or ground. Alternatively or in addition thereto, the wetting station 100 can also be provided for dispensing a fixing agent or for dispensing dyes used for the purpose of refining the surface.

The apparatus is furthermore provided with a longitudinal cutting station 110, arranged downstream of the discharging (wetting) station 100. As shown schematically in FIG. 2, the longitudinal cutting station 110 comprises several knives 112, which are arranged side by side and spaced-apart in a direction transverse to the web movement direction. The knives 112 are preferably embodied as rotary-driven circular blades, for which the respective axis of rotation is oriented transverse to the web movement direction. The knives 112 are furthermore positioned transverse to the movement direction of the sheet web 16, thus making it possible to adjust the spacing between two adjacent knives 112. The knives 112 can otherwise be moved if necessary far enough in transverse direction to be completely non-operational, to an idle position on the side of the sheet web 16.

In the longitudinal cutting station 110, the sheet web 16 is cut in the longitudinal or web movement direction with the knives 112 into a plurality of partial web sections that respectively correspond to a desired width for a book block page. As a result of the adjustability of the individual knives 112 transverse to the web movement direction of the sheet web 16, the spacing between two adjacent knives 112 can be adjusted to the desired width of a book block page, thus resulting in high format flexibility. If the width of a sheet web 16 is multiple times the width of a page for a book block to be produced with the apparatus, then a corresponding number of book blocks can be produced simultaneously.

FIG. 2 furthermore shows that the longitudinal cutting station 110 also comprises an edge strip suctioning device 114, which allows removing cut-off and unusable edge sections.

Downstream of the longitudinal cutting station 110, as seen in the web movement direction, a cross-cutting station 120 is furthermore arranged in which the partial webs, previously cut in the longitudinal direction by the preceding longitudinal cutting station 110, are each simultaneously cut transverse to the conveying direction into sheets having a length that corresponds to the height of a book block page. The cross-cutting station 120 can be provided with a cylindrical knife drum that extends over the complete width of the sheet web 16 and is provided with a spiral-type blade, arranged at an angle relative to the axis of rotation of the knife drum. Alternatively, it is also conceivable to provide the knife drum with several such blades that extend at and angle relative to the axis of rotation of the knife drum, for example with a number of blades that corresponds to the number of partial webs cut in the longitudinal cutting station 110.

Arranged downstream of the cross-cutting station 120, as seen in web movement direction, is a diverter 130 for separating out pages of poor quality, wherein the diverter is followed by a waste-material (reject) belt 132 that leaves the apparatus in a direction transverse to the web movement direction, as shown in FIG. 2. With the aid of the diverter 130 for separating out poor quality sheets, not shown in further detail but only schematically in the Figures, all sheets of poor quality, in particular those with faulty print images or faulty joining and/or splicing locations, or empty pages are separated out and removed from the apparatus with the aid of the waste-material belt 132.

An optical sensor that is not shown in the Figures is provided for this upstream of the diverter 130, wherein this optical sensor detects the number of sheets passing by and determines whether the detected number of sheets corresponds to the number of pages required for producing the book block. The optical sensor furthermore identifies sheets to be removed and, with the aid of a control unit that is not shown herein, correspondingly activates the diverter 130 for separating out poor quality sheets.

The diverter 130 for separating out poor quality sheets is followed by an overlapping station 140 in which the sheets supplied by the cross-cutting station 120 are arranged in an overlapping and thus scaled formation. The overlapping station 140 is provided for this with suitable delaying means (not shown in the Figures) for decelerating and overlapping the sheets.

The overlapping station 140 is followed in the downstream direction by a collecting station 150 that contains several side by side arranged compartments 152, shown schematically in FIG. 2. These compartments 152 are respectively delimited on the side by walls, not further designated in the Figures, which can be adjusted transverse to the web movement direction to adapt the width of the individual compartments 152 to the width of the sheets cut from the partial webs. The side walls of the compartments 152 should therefore be adjusted transverse to the web movement direction, corresponding to the adjustment of the knives 112 of the longitudinal cutting station 110, which ensures that the side walls of the compartments 152 in the collecting station 150 occupy the same position in transverse direction as the corresponding knives 112 of the longitudinal cutting station 110. In each of the compartments 152 of the collecting station 150, sheets are stacked one above the other to form a book block upon completion of the stack, wherein the number of compartments 152 corresponds to the number of partial webs, thereby making it possible to generate a corresponding number of parallel-produced sheet stacks to form book blocks. For the sake of completeness, each sheet in a stack represents a page for the book block to be produced, wherein the page "1" of a book block is deposited either on the top or on the bottom.

Additionally, the collecting station 150 may contain conveyor grippers that are not shown in the Figures, wherein each of the compartments 152 is advantageously assigned a conveyor gripper. The conveyor grippers serve to remove a completed stack in the form of a book block from the respective compartment 152 by clamping in the stack forming a book block between the jaws of the conveyor gripper.

Located adjacent to the collecting station 150 is an intermediate storage area 160 for the intermediate storage of high-quality and/or poor quality book blocks arriving from the collecting station 150.

FIG. 2 shows that a conveyor belt 170 follows the collecting station 150 and is used for conveying the book blocks, gathered inside the individual compartments 152 of the collecting station 150, to a binding station that is not shown in the drawings.

FIG. 2 furthermore schematically indicates a cross conveyor 180, provided for transferring the book blocks from a conveyor gripper of the collecting station 150 to the conveying belt 170, wherein this cross conveyor 180 can also have a circulating conveying belt. In addition, the cross conveyor 180 is effective not only in the direction of the conveying belt 170, but also in the direction toward the intermediate storage area 160, so that the book blocks from the collecting station 150 can be moved to the intermediate storage area if necessary.

The pulling forces of at least some of the drive units used may be monitored to take into account the different material qualities of the sheet web 16 that is used, wherein a torque meter may be used for measuring the pulling forces. The monitoring unit, which is not shown in the Figures, may be embodied for an adaptive control of the drive unit.

Figure 9:
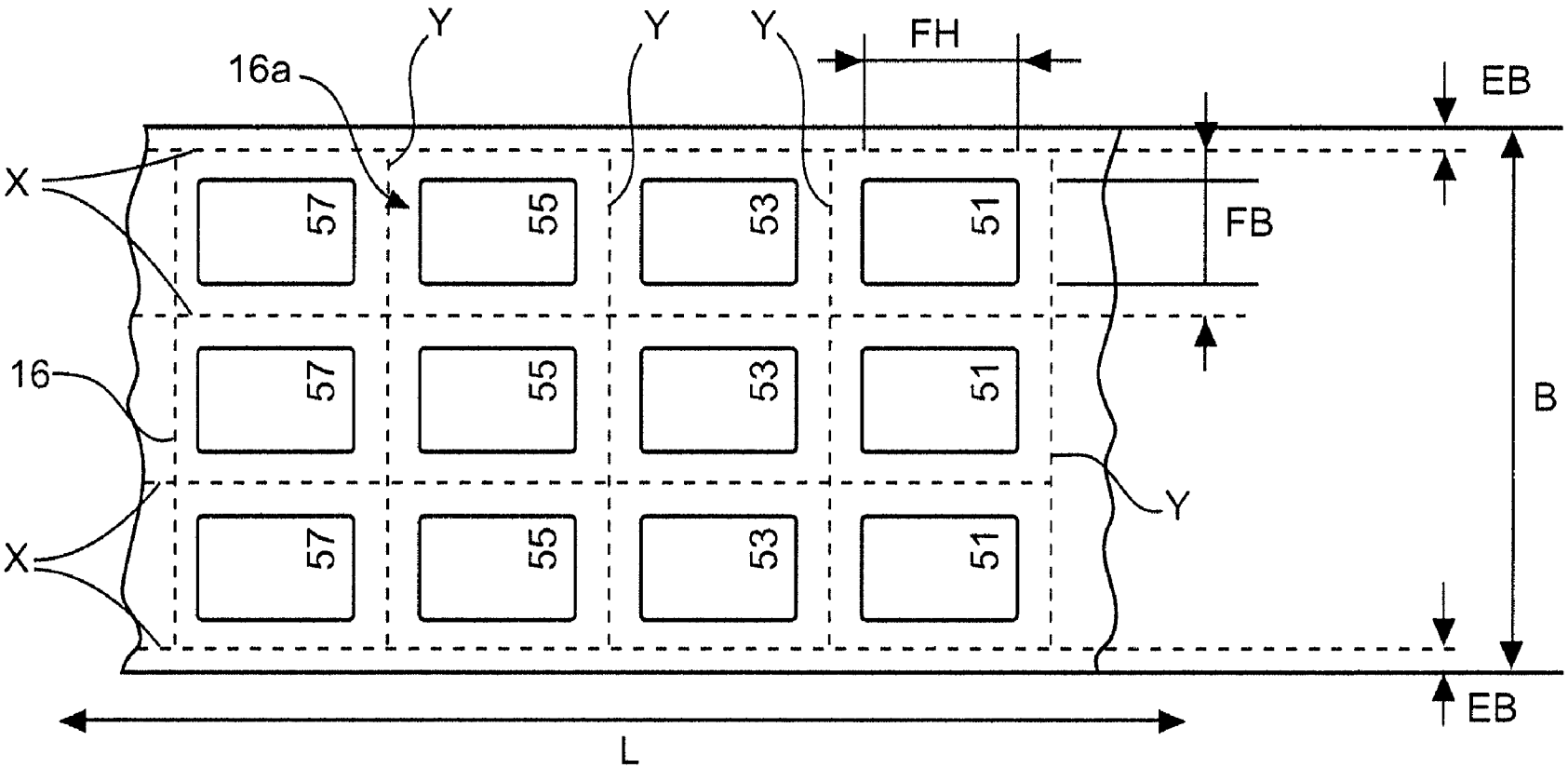
FIG. 9 is a view from above of sections of an imprinted sheet web.

FIG. 9 shows as example a section of the sheet web 16 that is imprinted with the previously described printing device and is then processed further. The sheet web 16 has a first surface and/or a side 16*a*, which is visible in FIG. 9, and an opposite-arranged surface or side that faces away from the observer in FIG. 9 and is therefore not visible. The sheet web 16 furthermore has a length L (this measure is naturally multiple times longer than shown for the section in FIG. 9) and a width B, wherein the width B is many times (three times according to the example in FIG. 9) a width FB of a book block page plus twice the width EB of the edge sections. The length L is a multiple of the height FH of a book block page, wherein a sheet produced from a sheet web 16 forms a page of a book block.

With the imprinted sheet web 16 according to FIG. 9, the first surface 16*a* that faces the observer and is thus visible in FIG. 9 was imprinted with the contents of the odd-numbered pages "51," "53," "55," "57." The second surface that faces away from the observer in FIG. 9 and is therefore not visible in FIG. 9 accordingly was imprinted with the content of the even-numbered pages "52," "54," "56," "58," wherein for this example the print image for page "52" is placed on the second surface of the sheet web 16 and in the same location as the print image for the page "51" on the first surface 16*a* of the sheet web 16. The same is correspondingly also true for the remaining pages "53"/"54," "55"/"56," "57"/58" and so forth. FIG. 9 furthermore shows dashed longitudinal lines X on the sheet web 16, which symbolize the cut made by the respective knifes 112 in the longitudinal cutting station 110 for cutting the web into partial webs with the width FB. In FIG. 9, dashed cross-cutting lines Y are furthermore shown, which indicate the cut made in the cross-cutting station 120 for cutting the partial webs into finished sheets having the width FB and the length and/or height FH, wherein the respective book block is composed of sheets with the width FB and the height FH.

It will be understood that the above description of the present invention is susceptible to various modifications, changes and adaptations, and the same are intended to be comprehended within the meaning and range of equivalents of the appended claims.

What is claimed is:

1. An apparatus for producing book blocks, said apparatus comprising:

a sheet web dispensing station to dispense at least one sheet web that moves in longitudinal direction and can be imprinted;

a printing station, including:

two cylinders which rotate with a circumferential speed that corresponds to the movement speed of the sheet web and which function to support in a contacting manner the sheet web with their circumferential surfaces over a specified angle region;

contactless operating printing heads assigned to each cylinder, arranged side by side at a distance to the circumferential surface of the associated cylinder and positioned at least essentially transverse to the circumferential and rotational direction of the associated cylinder, wherein the printing heads have faces oriented substantially tangential to the associated cylinder and wherein the center lines through the printing heads are oriented to project substantially radial to the circumferential surface of the associated cylinder;

a guiding device to guide the sheet web so that when the web rests on one cylinder, one side of the sheet web may be imprinted and when the web rests on the other cylinder, the other side of the sheet web may be imprinted; and a web tension device to generate a desired web tension in the sheet web;

a cutting station arranged downstream of the printing station and including:

a longitudinal cutter operative to cut the printed sheet web in a longitudinal direction; and a cross-cutter arranged downstream or upstream of the longitudinal cutter to cut the printed sheet web in a transverse direction, wherein the cutting station produces sheets arranged in at least two partial webs extending in the longitudinal direction, the sheets having a width and length that correspond to a predetermined height and width of pages of the book block to be produced;

an overlapping station arranged downstream of the cutting station to arrange the sheets in an overlapping formation; and a collecting station to collect the sheets of each partial web into stacks that form the book blocks, wherein the collecting station includes a number of compartments to collect the sheets of each partial web into book blocks, wherein the number of compartments corresponds to a number of the partial webs.

2. The apparatus according to claim 1, wherein the sheet web dispensing station comprises:

a holding device adapted to accommodate at least two rolls, wherein respectively only one sheet web is pulled off at a time; and a joining device to join an end of a web that is completely pulled-off one roll to the start of a still completely rolled-up sheet web of another roll.

3. The apparatus according to claim 1, further comprising a forward-feed device arranged downstream of the printing station to support transport of the sheet web.

4. The apparatus according to claim 3, further comprising an adjusting device arranged downstream of the printing station to adjust the sheet web.

5. The apparatus according to claims 4, wherein the adjusting device is arranged to adjust the sheet web on both sides and is arranged downstream of the forward-feed device.

6. The apparatus according to claim 1, further comprising a wetting device to apply liquid to the sheet web.

7. The apparatus according to claim 6, wherein the wetting device includes an antistatic device.

8. The apparatus according to claim 6, further comprising an adjusting device arranged downstream of the printing station to adjust the sheet web, wherein the wetting device is arranged downstream of the adjusting device.

9. The apparatus according to claim 1, wherein the longitudinal cutter includes a plurality of longitudinal cutting knives adjustably arranged with respect to a lateral spacing between the longitudinal cutting knives.

10. The apparatus according to claim 1, further comprising a suction device operatively arranged with the longitudinal cutter to suction off edge strips.

11. The apparatus according to claim 1, further comprising a diverter arranged downstream of the cutting station to separate out poor quality sheets.

12. The apparatus according to claim 11, further comprising a conveying belt coupled to the diverter and moving away at an angle to a movement direction of the sheet web.

13. The apparatus according to claim 11, wherein the diverter is arranged upstream of the overlapping station.

14. The apparatus according to claim 1, further comprising a conveyor gripper associated with each compartment to convey away the gathered book block.

15. The apparatus according to at claim 1, further comprising an intermediate storage area connected to the collecting station and adapted for intermediate storage of book blocks.

16. The apparatus according to claim 1, further comprising a conveying device which leaves the collecting station at and angle to transport the book blocks to a binding station.

17. The apparatus according to claim 16, wherein the conveying device comprises at least one conveying belt.

18. The apparatus according to claim 16, further comprising an intermediate storage area connected to the collecting station and adapted for intermediate storage of book blocks; and a feeding device which extends to the conveying device and to the intermediate storage area.

19. The apparatus according to claim 1, further comprising at least one drying unit to dry imprinted sections of the sheet web.

20. The apparatus according to claim 19, wherein the at least one drying unit is part of the printing station.

21. The apparatus according to claim 1, further comprising at least one web-edge control device.

22. The apparatus according to claim 21, wherein the at least one web-edge control device is part of the printing station.

23. The apparatus according to claim 22, wherein the web-edge control device is located upstream of at least one of the two cylinders.

24. The apparatus according to claim 1, further comprising at least one quality-measuring device.

25. The apparatus according to claims 24, further comprising a diverter arranged downstream of cutting station to separate out poor quality sheets, wherein the diverter is responsive to the at least one quality-measuring device to separate out those sheets which have been determined to be of poor quality.

26. The apparatus according to claim 24, wherein at least one quality-measuring device is provided in the printing station, and a quality measuring device is assigned to one of the cylinders and determines the quality of the sheet web after it leaves the one cylinder.

27. A method for producing book blocks, comprising the following steps:

providing at least one sheet web that moves in a longitudinal direction and can be imprinted;

pulling the sheet web through a printing station successively across two cylinders to form a wrap-around angle about each cylinder and imprinting the web with the aid of contactless operating printing heads that are assigned, respectively, to each cylinder and are arranged side by side at a distance to the circumferential surface of the associated cylinder, and at least essentially transverse to the circumferential and rotational direction of the associated cylinder, wherein the faces of the printing heads are oriented substantially tangential to the associated cylinder and center lines of the printing heads are oriented to project substantially radial to the circumferential surface of the associated cylinder;

guiding the sheet web with a specified web tension through the printing station so that when the web rests on the one cylinder, one side of the sheet web is imprinted and when the web comes to rest on the other cylinder, the other side of the sheet web is imprinted;

longitudinally cutting the imprinted sheet web in a longitudinal direction;

transversely cutting the imprinted sheet web transverse to the conveying direction, wherein the longitudinal and transverse cutting steps produce sheets arranged in at least two partial webs extending in the longitudinal direction, the sheets having that have a length and width that correspond to a predetermined height and width of pages of the book block to be produced;

arranging the sheets of each partial web in an overlapping formation; and collecting the overlapped sheets from inside a collecting station to produce stacks that form book blocks, wherein the collecting station includes a number of compartments to collect the sheets of each partial web into book blocks, wherein the number of compartments corresponds to a number of the partial webs.

28. The method according to claim 27, wherein the longitudinal cutting is performed prior to transverse cutting so that at least two side by side partial web section are produced that are subsequently cut in the transverse direction to produce the sheets.

29. The method according to claim 27, wherein the transverse cutting is performed prior to the longitudinal cutting so that partial web sections positioned one behind the other are produced that are subsequently cut in the longitudinal direction to produce the sheets.

30. The method according to claim 27, further comprising the steps of imprinting in the movement direction a first surface of the sheet web along partial webs that are arranged side by side and transverse to the movement direction with the content of a sequence of m odd-numbered pages and imprinting in the movement direction the second surface of the sheets web along partial webs positioned side by side and transverse to the movement direction with the contents of the sequence of n even-numbered pages.

31. The method according to claim 30, further comprising arranging the contents of an odd-numbered page on the first surface of the sheet web essentially in the same position as the content of the consecutively following even-numbered page on the second surface of the sheet web.

32. The method according to claim 30, wherein a length of the sheet web is at least a multiple of a height multiplied with the maximum of m and n.

* * * * *